US005237834A

United States Patent [19]

Grossel

[11] Patent Number: 5,237,834

[45] Date of Patent: Aug. 24, 1993

[54] PRE-CHILLER FOR ICE MAKER

[76] Inventor: Edward J. Grossel, 4716 Garcia Ave., Sarasota, Fla. 34233

[21] Appl. No.: 966,691

[22] Filed: Oct. 26, 1992

[51] Int. Cl.[5] ..... F25C 1/00

[52] U.S. Cl. ..... 62/348; 141/113

[58] Field of Search ..... 62/348, 158; 144/113; 137/577; 165/132, 147

[56] References Cited

U.S. PATENT DOCUMENTS

| | | | |
|---|---|---|---|
| 2,362,694 | 11/1944 | Hill | 165/147 X |
| 2,657,547 | 11/1963 | Heuser | 137/577 X |
| 2,674,858 | 4/1964 | Magnuson et al. | 62/348 X |
| 4,246,927 | 1/1981 | Eberle | 137/577 X |
| 4,338,794 | 7/1982 | Haasis, Jr. | 62/348 |
| 4,550,572 | 11/1985 | Schulze-Berge | 62/158 X |
| 4,798,061 | 1/1989 | LaConte | 62/348 |
| 4,848,102 | 7/1989 | Stanfill | 62/348 |
| 4,881,378 | 11/1989 | Bryant | 62/348 |

*Primary Examiner*—William E. Tapolcai

*Attorney, Agent, or Firm*—Charles J. Prescott

[57] ABSTRACT

A pre-chiller for an incoming fresh water supply of an ice maker. The device is connectable onto an upright surface of the existing ice maker, a separate wall surface or the like and includes a chamber for receiving and holding cold waste water discharged from the ice maker during each ice making cycle. A standpipe connected within the chamber drains the waste water while automatically maintaining waste water level within the chamber. A fresh water cooling conduit, preferably comprised of a plurality of enlarged hollow stainless steel cylinders connected for series flow of fresh water therethrough, is positioned submersed in the cold waste water within the chamber. During each ice maker cycle, cold waste water is delivered into the chamber and fresh water being held for chilling within the cooling conduit by the surrounding waste water is moved into the ice maker water inlet. A time delay between start up of the ice maker water pump and chilled fresh water delivery is also provided to pre-chill the evaporator plate within the ice maker, which reduces expansion valve frustration.

7 Claims, 2 Drawing Sheets

PRE-CHILLER FOR ICE MAKER

BACKGROUND OF THE INVENTION

This invention relates generally to ice making machines, and more particularly to a device for pre-chilling the incoming fresh water supply of an existing ice making machine.

Ice making machines are used extensively in conjunction with commercial establishments such as restaurants which utilize large quantities of ice and by businesses which commercially manufacture ice. These devices utilize conventional refrigeration means to freeze incoming fresh water in an arrangement wherein a quantity of waste water emanates and must be disposed of during each ice making cycle. This waste water accumulates both from the reverse refrigerant cycle which heats and eliminates any excess ice build-up on evaporator plates and also from the waste water which drips from ice cubes stored in the bin within the ice maker. Although this waste water is quite cold and almost at the freezing temperature of water, nonetheless it is contaminated and typically discharged into a drain for disposal.

The cycle time for such ice making machines is limited by the temperature of the incoming fresh water. In most instances, this temperature is at ambient or in the vicinity of 70 to 80 degrees F. Thus, during each cycle, each new charge of fresh water must be reduced approximately 35–40 degrees F.

One patented device known to applicant, U.S. Pat. No. 4,848,102 invented by Stanfill, discloses an ice making apparatus which captures and utilizes the cold waste water in a manner which pre-cools the incoming fresh water by positioning it in heat exchange fashion with respect to the cold waste water within a hellcal concentric conduit.

Another similar device is disclosed in U.S. Pat. No. 4,338,794 issued to Haasis. This device receives the cold waste water from the ice cube bin into a uniquely configured heat exchanger which prevents co-mingling between fresh and waste water.

Yet another such high speed ice maker has been invented by Bryant as disclosed in U.S. Pat. No. 4,881,378 which reduces the temperature of tap water while enroute to the ice making section of the ice maker by flowing the fresh water through a coiled tubing emersed in waste water accumulated within a flat reservoir beneath the ice cube storage bin.

The only pre-cooler known for existing ice making machines is disclosed in U.S. Pat. No. 4,798,061 invented by LaConte in which the fresh water is circulated through tubing immersed in the ice bank of a beverage delivery system such as found in fast food restaurants.

The present invention provides a compact arrangement connectable onto an upright wall such as that of an existing ice making machine whereby the waste water from the ice maker is temporarily stored within a chamber of the device for pre-chilling fresh water flowing through a heat exchange conduit positioned within the chamber. The waste water level within the chamber is automatically maintained by a standpipe, this arrangement also facilitating flushing and cleansing of the interior of the chamber by the upward flow of waste water within the chamber during each freezing cycle. A unique and preferred arrangement of series connected stainless steel cylinders for holding a quantity of fresh water within the chamber facilitates holding a larger quantity of fresh water for pre-chilling during each ice maker freezing cycle.

BRIEF SUMMARY OF THE INVENTION

This invention is directed to a pre-chiller for an incoming fresh water supply of an ice maker. The device is connectable onto an upright surface of the existing ice maker, a separate wall surface or the like and includes a chamber for receiving and holding cold waste water discharged from the ice maker during each ice making cycle. A standpipe connected within the chamber drains the waste water while automatically maintaining waste water level within the chamber. A fresh water cooling conduit, preferably comprised of a plurality of enlarged hollow stainless steel cylinders connected for series flow of fresh water therethrough, is positioned submersed in the cold waste water within the chamber. During each ice maker cycle, cold waste water is delivered into the chamber and fresh water being held for chilling within the cooling conduit by the surrounding waste water is moved into the ice maker water inlet. A time delay between start-up of the ice maker water pump and chilled fresh water delivery is also provided to pre-chill the evaporator plate within the ice maker, which reduces expansion valve frustration.

It is therefore an object of this invention to provide a retrofit pre-chiller for incoming fresh water for existing ice making machines.

It is another object of this invention to provide a retrofit pre-chiller which utilizes the cold waste water which would otherwise be discharged from the ice making machine for disposal.

It is yet another object of this invention to provide a pre-chiller which is generally self-flushing and cleansing as a result of the upward flow of waste water within the chamber of the device during each ice making cycle.

It is yet another object of this invention to provide a uniquely structured fresh water cooling conduit within the chamber of the device for holding a larger quantity of fresh water for pre-chilling during each ice maker cycle.

It is yet another object of this invention to provide a pre-chiller for ice making machines which is easily adjustable to accommodate the variable fresh water needs and available dump valve flow pressure during each ice maker cycle.

It is yet another object of this invention to provide a variable time delay for delivery of pre-chilled fresh water into the ice maker until the freon compressor develops a preselected freon suction pressure.

In accordance with these and other objects which will become apparent hereinafter, the instant invention will now be described with reference to the accompanying drawings.

DETAILED DESCRIPTION OF THE INVENTION

Figure 2:
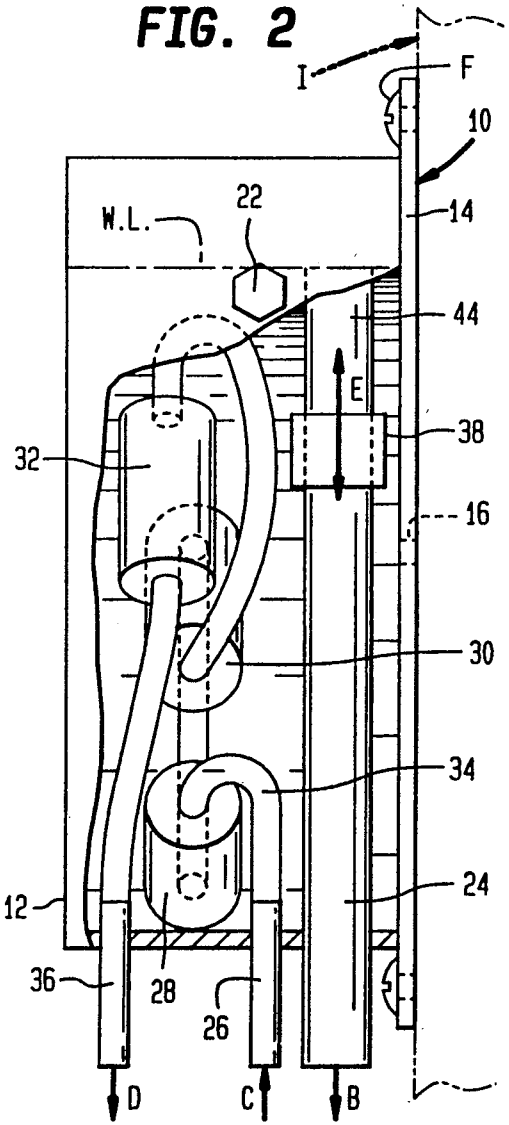
FIG. 2 is a right end elevation partially broken view of FIG. 1 shown connected to an upright wall of an existing ice maker shown in phantom.
Figure 1:
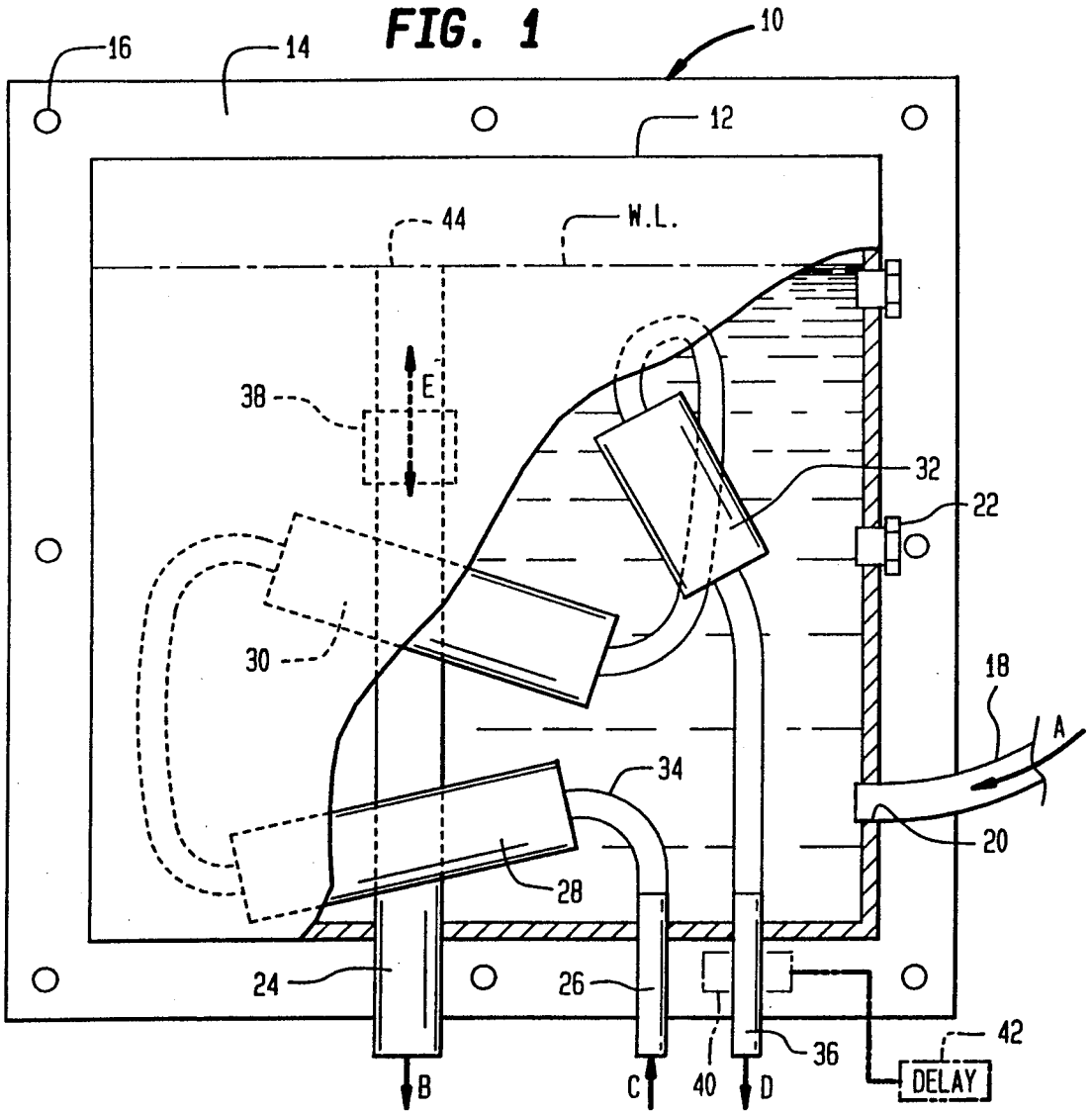
FIG. 1 is a side elevation partially broken view of one embodiment of the invention.

Referring now to the drawings and particularly to FIGS. 1 and 2, one embodiment of the invention is shown generally at numeral 10 and includes a thin-wall polypropylene plastic rectangular hollow chamber 12 having a mounting flange 14 to facilitate mounting of the device 10 through mounting holes 16 and fasteners F onto ice maker I. The chamber 12 includes a plurality of waste water inlets 20 spaced vertically along a wall of the chamber 12 and which are each sealed with removable threaded plugs 22.

Upon installation of the device 10, one of the threaded plugs 22 is removed and a conduit 18 is connected within the remaining threaded hole 20. Conduit 18 is connected at its opposite end to a waste water dump valve (not shown) of the ice machine I. This waste water is accumulated from the freezing portion of the ice maker during its reverse refrigerant heating cycle.

A standpipe 24 is mounted in upright orientation within the chamber 12 so that its lower end will freely discharge waste water by gravity downwardly in the direction of arrow B for disposal. The upper end 44 of the standpipe 24 is open and defines the water level WL of the waste water accumulated within the chamber 12. A telescoping arrangement 38 facilitates the variability of the height of the water line WL by movement of upper end 26 up and down in the direction of arrow E. By this arrangement, the waste water flowing through inlet conduit 18 in the direction of arrow A into the chamber 12 is maintained at a desired water level WL.

In order to pre-chill at least a portion of the fresh water utilized within the ice maker I during each freezing cycle, a cooling conduit arrangement is situated within the cold waste water within chamber 12. The preferred embodiment of this cooling conduit is in the form of a plurality of stainless steel hollow cylinders 28, 30, and 32 which are interconnected by either flexible or, preferably rigid stainless steel tubing shown typically at 34. This cooling conduit arrangement is connected in series with the fresh water inlet 26 which delivers fresh water in the direction of arrow C into the cooling conduit arrangement and the fresh water outlet 36. The fresh water then flows into each of the hollow cylinders 28, 30 and 32 during each ice making cycle and remains there in heat exchange relation with the cold waste water within the chamber 12 until the beginning of the next ice making cycle. At that time, the pressurized fresh water supply in the direction of arrow C moves the pre-chilled fresh water out of the cooling conduit arrangement through outlet 36 in the direction of arrow D into the ice maker for use.

A typical ice maker will utilize between 32 and 64 ounces of fresh water during each ice making cycle. If a coil of tubing is utilized as a heat exchanger to be placed within the chamber 12, the length of tubing necessary to pre-chill such a quantity of fresh water becomes unwieldy. For example, if a tubing having a ¼" I.D. is utilized, approximately 1,160 inches of tubing would be required to hold approximately 32 ounces of fresh water.

On the contrary, by utilizing the plurality of enlarged diameter stainless steel cylinders 28, 30 and 32, each having a 1½" I.D., only a length of approximately 32 inches overall is required, i.e. each cylinder having a length of approximately 11 inches. Although the heat exchange surface area is somewhat reduced by this preferred arrangement, nonetheless the length of time of exposure of the fresh water in heat exchange fashion with the cylinders 28, 30 and 32 is sufficient to significantly reduce the fresh water temperature.

In experimental testing, the device as above described in its preferred embodiment, in conjunction with pre-existing ice making machines, has shown a productivity increase of up to 25 percent. Although alternate embodiments of the cooling conduit would perhaps deliver increased efficiencies, the expense and impracticality of doing so would be less desirable.

To facilitate the purging and automatic cleansing of organic build-up within the chamber 12 as a result of waste water sitting therewithin, the waste water inlet conduit 18 is preferably connected within the lowest threaded inlet 20. By this arrangement, the waste water flowing into the chamber 12 in the direction of arrow A will upwardly migrate toward the opening 26 of the standpipe 24 during each cycle so as to minimize the number of cycles any portion of the waste water contained within chamber 12 will remain there. However, the dump valve arrangement present within existing ice machines varies in its pressurized output removal of the waste water. Where the available pressure for removing the waste water is relatively low, an upper most inlet 20 may be utilized so as to minimize the pressure head created by the water level WL resisting waste water flow into the chamber 12.

A time delay relay 42 is preferably provided which momentarily delays the start of the ice maker water pump 40 (up to two minutes). This time delay is provided so that the ice maker evaporator plate will pre-chill so as to instantaneously freeze the incoming pre-cooled fresh water. Otherwise, the compressor expansion valve is likely to rapidly cycle on and of initially until the freezing process has been initiated. Relay 42 may be arranged on any area of the invention at a predetermined compressor suction pressure as a signal to accomplish this time delay.

Figure 4:
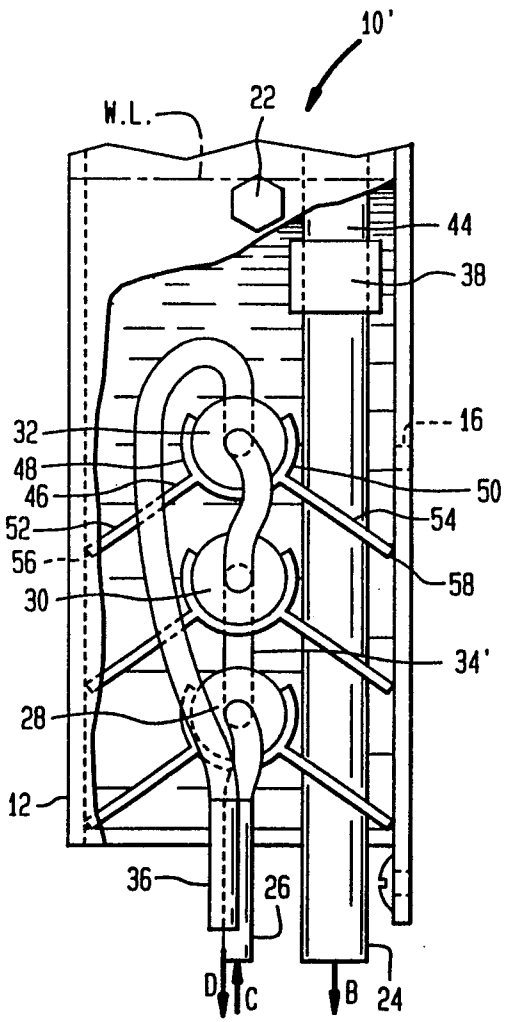
FIG. 4 is an enlarged right end partial elevation broken view of FIG. 3.
Figure 3:
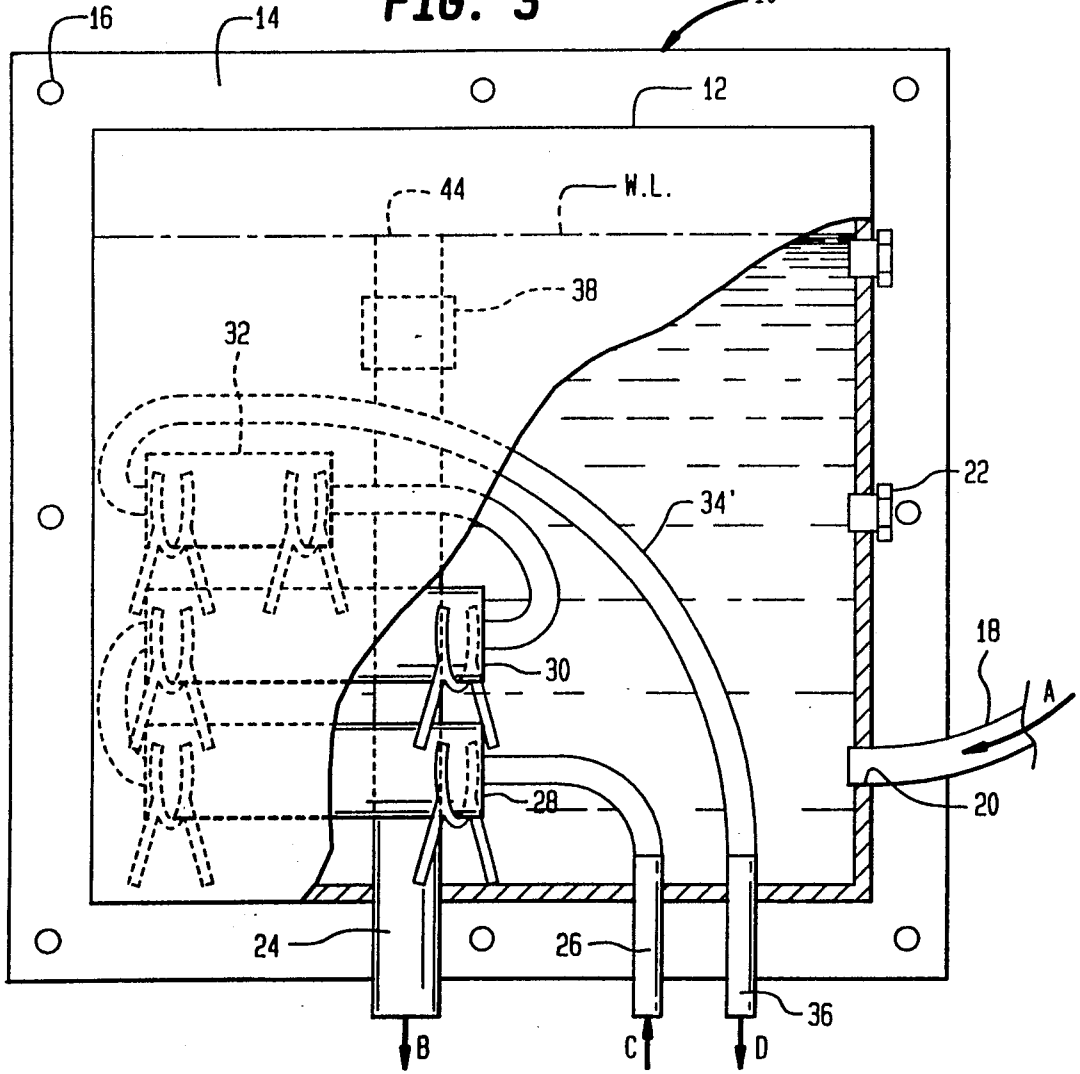
FIG. 3 is a side elevation partially broken view of the preferred embodiment of the invention.

Referring now to FIGS. 3 and 4, the preferred embodiment of the invention is shown generally at numeral 10' and includes a chamber 12, mounting flange 14 and other inlet and outlet components as previously described. However, in this preferred embodiment 10', the hollow cylinders 28, 30, and 32 are interconnected by either flexible or preferably rigid stainless steel tubing shown typically at 34' in an arrangement where the cylinders 28, 30 and 32 are each horizontally disposed and vertically spaced one to another as shown. Each hollow cylinder 28, 30 and 32 is not only held in its proper position as shown by the tubing segments shown typically at 34', but also by retaining clips 46. These retaining clips 46 include a segmented annular resilient body having opposing segments 48 and 50 which, when flexed open, will engage around each of the cylinders 28, 30, and 32 and then biasedly remain in that position when released. That is to say, segments 48 and 50 define a cylindrical surface in their free state which is smaller than that of each of the cylinders 28, 30, and 32.

To facilitate biasingly opening the annular segments 48 and 50 and to secure the positioning of each of these retainers 46, diagonally downward extending legs 50 and 52 are also provided each having a distal end 56 and 58 which will biasingly engage against the opposing inner surfaces of the wall panels of chamber 12. Of course, other similar spring clips may be utilized for this securement; however, the general concept is to provide further an economical spring clip means for securing these cylinders 28, 30, and 32 in a spaced and secure position within chamber 12.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pre-chiller for an incoming fresh water supply of a high speed ice maker comprising:

a hollow chamber having a waste water inlet fitting connectable to a conduit for delivering a quantity of chilled waste water discharged from the ice maker into said chamber;

said chamber having mounting means for connecting said chamber onto an upright surface such as a side panel of the ice maker;

an upright standpipe connected at a lower end thereof through and outwardly extending from a panel of said chamber, said standpipe having an open upper end positioned within said chamber and defining a chamber interior waste water level;

said waste water inlet fitting being positioned near a bottom surface of said chamber whereby waste water received into said chamber is flushed upwardly toward said standpipe upper end during each ice maker cycle;

a fresh water cooling conduit positioned within said chamber below said waste water level and having an inlet connected to a supply of fresh water and an outlet connected to a fresh water inlet of the ice maker;

the ice maker, during each ice making cycle, delivering the waste water accumulated within the ice maker into said chamber up to said waste water level, any excess waste water being discharged through said standpipe to a drain, the ice maker during each ice making cycle also receiving substantially all of the chilled fresh water held within said cooling conduit during a previous ice making cycle.

2. A pre-chiller as set forth in claim 1, further comprising:

a second waste water inlet fitting connected to said chamber and positioned above said waste water fitting whereby a waste water pressure head created within said chamber which resists waste water flow into said chamber through said second waste water inlet is reduced.

3. A pre-chiller as set forth in claim 1, wherein:

said cooling conduit includes a plurality of hollow stainless steel cylinders connected for series flow of fresh water therethrough whereby the quantity of fresh water held for pre-chilling within said chamber is increased.

4. A pre-chiller as set forth in claim 3, further comprising:

auxiliary spring clip means for securing a relative position of each of said cylinders within said chamber.

5. A pre-chiller as set forth in claim 1, wherein:

said standing pipe is telescopically adjustable in length whereby said waste water level is vertically adjustable within said chamber.

6. A pre-chiller as set forth in claim 1, further comprising:

means for delaying delivery of the chilled fresh water within the cooling conduit into the ice maker fresh water inlet a time sufficient at the beginning of each ice maker cycle for pre-chilling of the ice maker evaporator plate.

7. A pre-chiller as set forth in claim 6, wherein:

said delay means begins delivery of the chilled fresh water into the ice maker at a preselected suction pressure of a freon compressor within the ice maker.

* * * * *